United States Patent [19]

Yamazaki et al.

[11] Patent Number: 4,900,981

[45] Date of Patent: Feb. 13, 1990

[54] FLAT-SHAPED DISPLAY APPARATUS

[75] Inventors: Fumio Yamazaki, Kirakata Toyonaka; Kaoru Tomii, Isehara; Hiroshi Miyama, Yokohama; Toshifumi Nakatani, Moriguchi; Kiyoshi Saeki, Toyonaka, all of Japan

[73] Assignee: Matsushita Electric Industrial Co., Kadoma, Japan

[21] Appl. No.: 943,458

[22] Filed: Dec. 19, 1986

[30] Foreign Application Priority Data

Dec. 20, 1985 [JP] Japan ..... 60-288477

[51] Int. Cl.[4] ..... H01J 29/70

[52] U.S. Cl. ..... 313/422; 313/476; 313/477 R; 313/482; 313/495

[58] Field of Search ..... 313/495, 422, 476, 477 R, 313/482

[56] References Cited

U.S. PATENT DOCUMENTS

| | | | |
|---|---|---|---|
| 3,935,500 | 1/1976 | Oess et al. | 313/422 |
| 4,145,633 | 3/1979 | Peters et al. | 313/422 |
| 4,325,489 | 4/1982 | Russell et al. | 313/422 |
| 4,451,759 | 5/1984 | Heynisch | 313/495 |
| 4,525,653 | 6/1985 | Smith | 313/422 X |
| 4,752,721 | 6/1988 | Nishida et al. | 313/422 X |

FOREIGN PATENT DOCUMENTS 53-141571 12/1978 Japan .

*Primary Examiner*—Palmer C. DeMeo
*Assistant Examiner*—Michael Horabik
*Attorney, Agent, or Firm*—Cushman, Darby & Cushman

[57] ABSTRACT

In a flat-shaped display apparatus has a face plate, a rear plate, side plates, and necessary electrodes therein, a supporting plate and plural supporting rods which are connected to an edge of the supporting plate at intervals of a certain distance are provided between the face plate and the rear plate. The supporting rods are made of metal and all bonded parts are covered by guide plates so that no adhesive is exposed to the electron beams. Therefore, over-scanning of the electron beams can be made, without the electron beams impinging on the adhesive thereby enabling effective distortion compensation.

14 Claims, 5 Drawing Sheets

FLAT-SHAPED DISPLAY APPARATUS

FIELD OF THE INVENTION AND RELATED ART STATEMENT

1. FIELD OF THE INVENTION

The present invention relates to a display apparatus, and particularly to a flat-shaped cathode ray tube used for a color television, a display for a computer and the like.

2. DESCRIPTION OF THE RELATED ART

FIG. 9 is a cross-sectional view of a conventional flat-shaped display apparatus in a published unexamined patent application Ser. No. Sho 53-141571. A stripe-shaped phosphor screen 101 is coated on an inner surface of a face plate 100. Electrodes 103 are provided on an inner surface of a rear plate 102. Side plates 104 hold the face plate 100 and the rear plate 102 with a certain space therebetween, thereby making a vacuum cavity 120. Plural supporting plates 105 are provided in parallel in the vacuum cavity 120. Supporting strips 106 formed of a metal member extend perpendicularly to the face of the sheet of the drawing and are respectively provided on an end of respective supporting plates 105. The phosphor screen 101 is supported against outer atmospheric pressure by the supporting strips 106 and the supporting plates 105. Holding plates 107 and plate springs 108 prevent movement of the supporting strips 106 in the directions of arrows A and B. The tip of the supporting strips 106 are tapered and touch black lines of the phosphor screen 101. A shadow mask 109 also is provided close to the phosphor screen 101 in parallel thereto. Modulation and deflection electrodes 110, 111 and 112 for modulating and deflecting electron beams are disposed close to the rear plate 102 in parallel thereto. The electron beams thus fly in a direction of an arrow C and pass through the shadow mask 109. The electron beams then impinge on the phosphor screen 101, which thereby emits light.

When the supporting strip 106 warps or undulates in the above-mentioned display apparatus, the tip of the supporting strip 106 slips out of the black lines of the face plate 100 and transfers to an emitting part of the phosphor screen 101. Therefore, a shadow is produced in a display image.

Also, this conventional display apparatus has such a disadvantage that the known method of detecting scanning position and scanning timing, which is for producing a good quality picture image as disclosed in a published unexamined patent application Ser. No. Sho 61-202592, cannot be applied to the above-mentioned conventional display apparatus.

The method of detecting scanning position and scanning timing in this apparatus is devised so as to provide a good and stable picture quality by application thereof to a display apparatus having a rather rough precision for assembly. In the method, the scanning position and the scanning timing with regard to each scanning beam on the phosphor screen is detected and memorized. A color video signal applied to the modulation electrode is modified for compensation of positional deviation of the supporting strip or the like by utilizing the detected scanning position and the scanning timing signal, thereby attaining a good quality picture. In such a method, when the signal of the scanning position and the scanning timing is detected, a part of the phosphor screen, which is disposed a little out of a picture area, is scanned by the electron beam for obtaining a more precise and detailed scanning position timing signal.

However, in the above-mentioned conventional display apparatus, the scanning of the electron beam on the phosphor screen at the part out of the picture area is hindered by the existence of supporting strip 106. Therefore, the precise signal of the scanning position and the scanning timing cannot be detected.

OBJECT AND SUMMARY OF THE INVENTION

In view of the problems of the conventional display, the display apparatus of the present invention intends to resolve the above-mentioned problems.

The display apparatus of the present invention comprises:

a face plate having a phosphor screen coated on its inner surface, a rear plate provided apart from the face plate in parallel, side plates for forming a vacuum enclosure by connecting the face plate and the rear plate with a given space therebetween, electron beam emitting means for emitting electron beams, plural supporting plates disposed in parallel to each other between the face plate and the rear plate, and substantially perpendicular to the face plate, and plural supporting rods, one ends of which are bonded on end of the supporting plate at intervals of a certain distance by adhesion and the other ends of which are tapered touch the face plate.

DESCRIPTION OF THE PREFERRED EMBODIMENTS

Figure 1:
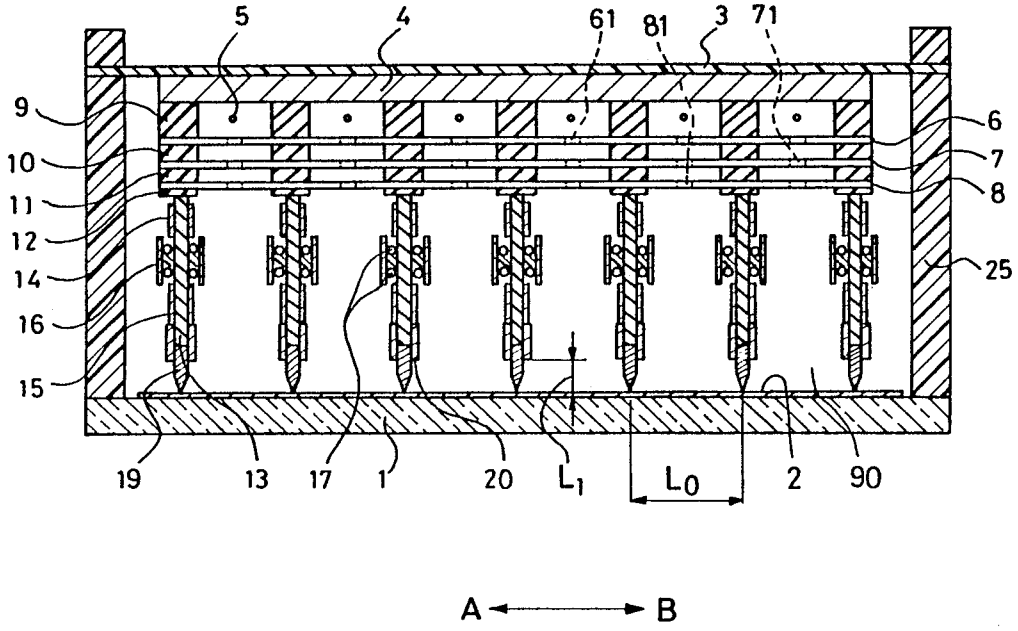
FIG. 1 is a cross-sectional view showing an embodiment of the display apparatus of the present invention.

An embodiment of the present invention is described referring to FIG. 1 through FIG. 8. FIG. 1 is a sectional view of a flat-shaped display apparatus of the present invention. A stripe-shaped phosphor screen 2 is formed on an inner surface of a face plate 1. A rear plate 3 is disposed at a certain distance apart from the face plate 1 in parallel. Side plates 25 form a vacuum cavity together with the face plate 1 and the rear plate 3. A back electrode 4 is disposed on an inner surface of the rear plate 3. Line cathodes 5 are disposed in front of the back electrode 4 and electron beams are emitted from the cathodes 5 to the phosphor screen 2. The direction of the line cathodes 5 are perpendicuclar to the drawing sheet. Modulation and deflection electrodes 6, 7 and 8 respectively have plural holes 61, 71 and 81 through which electron beams pass, and these electrodes modulate and deflect the electron beam emitted from the line cathodes 5. Spacers 9, 10 and 11 isolate the electrodes 6, 7 and 8 from each other. The spacers 9, 10 and 11 are perpendicular to the drawing sheet. Mounts 12 are provided on the electrode 8. Supporting plates 13 are disposed on respective mounts 12 in parallel to each other. The supporting plates 13 are substantially perpendicular to the face plate 1.

Figure 2:
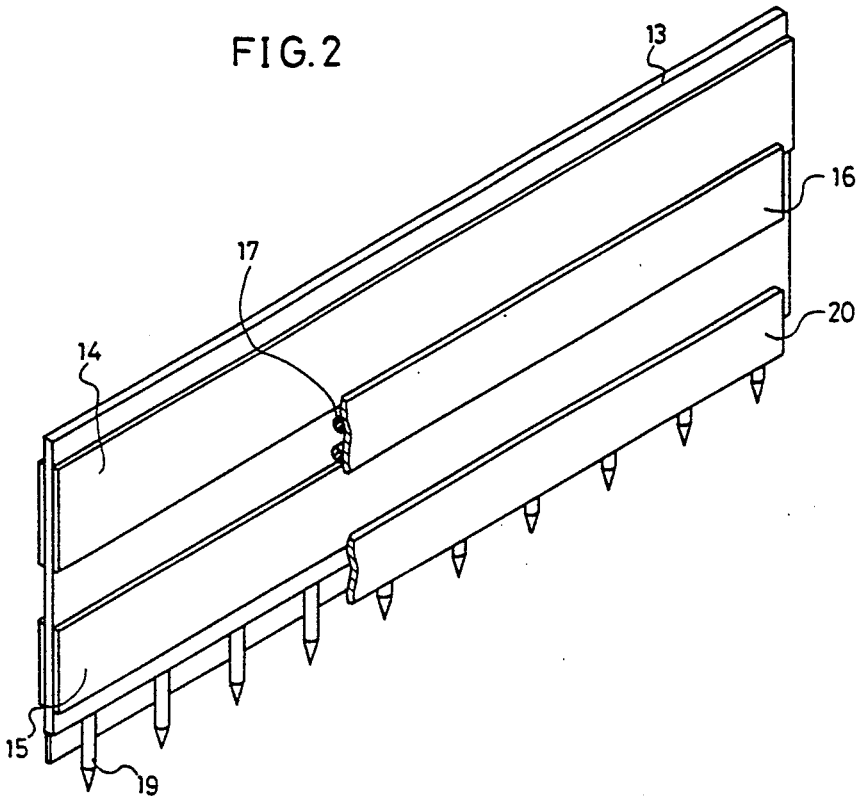
FIG. 2 is a perspective view showing a supporting plate and supporting rods of the present invention.
Figure 3:
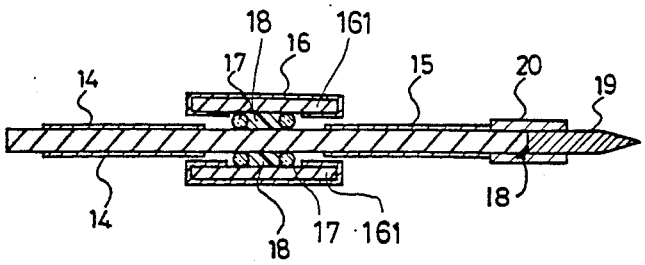
FIG. 3 is a cross-sectional view showing the supporting plate and the supporting rods of the present invention.

FIG. 2 is a perspective view showing the supporting plate 13, and FIG. 3 is a cross-sectional view showing the supporting plate 13. As shown in the figures, supporting plate 13 is made of an insulation member of glass material, and the like and the lengthwise direction of the supporting plates 13 is perpendicular to the drawing sheet of FIG. 1. The plural supporting plates 13 are disposed apart from each other in parallel. Horizontal electrodes 14 and 15 of metal layers are formed on both sides of the supporting plate 13 by a sputtering CVD method, an evaporation method, a plating method or the like. Horizontal electrodes 16 are provided apart from the supporting plate 13 by a small distance by using spacers 17. Cores 161 of horizontal electrodes 16 are made of an insulative material having the same heat expansion coefficient as that of the supporting plate 13, and metal film formed on the insulating material. The edges of the electrodes 14 and 15 hang over a space between the supporting plates 13 and the electrodes 16. The spacers 17 are made of an insulative material such as glass fiber. The core 161 of the horizontal electrode 16, the supporting plates 13 and the spacers 17 are bonded to each other by using adhesive means 18 of frit glass having a low melting temperature. The bonding is executed by pressing the cores 161 of electrode 16 to the supporting plate 13. Supporting rods 19 made of a metal member are fixed to an edge end of the supporting plate 13 at intervals of a certain distance by using adhesive 18, which may be for example, frit glass. The heat expansion coefficient of the supporting rods 19 are nearly the same as that of the supporting plate 13, and the tip of the supporting rods 19 are tapered and made to touch the black lines of the phosphor screen 2. The supporting rods 19 of both side parts of the supporting plate 13 are made a little longer than the supporting rods 19 at the center part of the supporting plate 13.

Guide plates 20 guide the bonding of supporting plate 13, are made of an insulative material on which surfaces are coated a metal layer. The heat expansion coefficient of the guide plates 20 are almost the same as that of the supporting plates 13. The distance $L_1$ from the front end of the guide plate 20 to the inner wall of the face plate 1 shown in FIG. 1 is designed so that the guide plate 20 does not obstruct scanning of electron beams even when the electron beam scan a little outside of a given horizontal scanning area (picture area: $L_0$ of FIG. 1).

As shown, the length of the supporting rod 19 is larger than $L_1$.

The atmospheric pressure is impressed on the rear plate 3, the face plate 1 and the side plates 25 since the inner space of the cavity 90 is kept in a vacuum. The back electrode 4, the spacers 9, 10 and 11, the electrodes 6, 7 and 8, the supporting plates 13 and the supporting rod 19 bear an outer pressure applied on the face plate 1 due to the atmospheric pressure. The electron beams emitted from the cathode 5 pass through the electrodes 6, 7 and 8 and are deflected by the horizontal deflection electrodes 14, 15 and 16 in a direction indicated by arrow A or B. Further, the electron beam impinge on the phosphor screen 2 so that it emits light. The index phosphor screen and the detecting circuit and the like for obtaining a scanning position and timing signal are abridged from the drawings.

FIG. 4 through FIG. 7 show another embodiment of the supporting plate 13 and the supporting rods 19.

Figure 4:
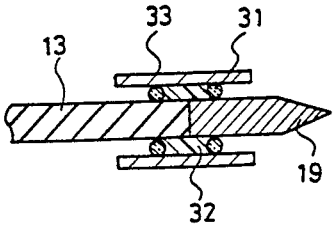
FIG. 4 is a partial cross-sectional view showing an attachment constitution of the supporting rods of the present invention.

In FIG. 4, the supporting plate 13 and the supporting rod 19 are bonded on each other with four glass fibers 31 and guide plates 33 by adhesive 32, for example.

Figure 5:
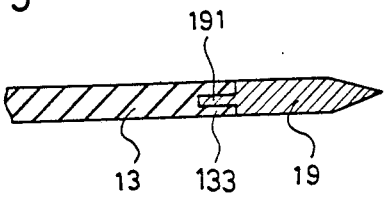
FIG. 5 is a partial cross-sectional view showing another attachment constitution of the supporting rods of the present invention.

In FIG. 5, the supporting rod 19 has a protrusion 191 on a rear part, and the protrusion 191 is pushed into a groove 133 of the supporting plate 13, thereby connecting the supporting rod 19 and the supporting plate 13.

Figure 6:
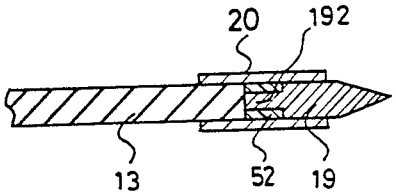
FIG. 6 is a partial cross-sectional view showing still another attachment constitution of the supporting rods of the present invention.

In FIG. 6, a protrusion 192 is formed on a rear part of the supporting rod 19 and adhesive 52 is provided on the protrusion 192. The supporting plate 13 and the supporting rod 19 are connected by the adhesive 52 and guide plate 20. The adhesive 52 can be of a solid type.

Figure 7:
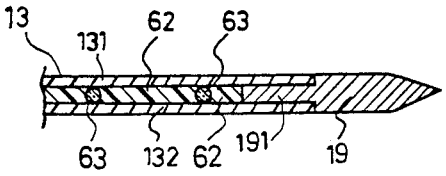
FIG. 7 is a partial cross-sectional view showing another attachment constitution of the supporting rods of the present invention.

In FIG. 7, the supporting plate 13 comprises two members 131 and 132. Fiber spacers 63 and the protrusion 191 of the supporting rod are sandwiched by the two members 131, 132. An adhesive 62 bonds the supporting plate 13 and the supporting rod 19.

In the above-mentioned embodiments, since the supporting rod 19 is made of a metal member, electric discharge does not accumulate even when the electron beam impinges on the supporting rod 19. Also, since in the above-mentioned embodimets of the supporting plate 13 and the supporting rod 19 all the bonded parts are covered by the guide plates 20 or 33, no adhesive is exposed to the electron beams. Therefore, undesirable discharges which cause imagenoise are not produced.

Since the heat expansion coefficients of the supporting rods 19 and the supporting plates 13 are almost the same with respect to each other, cracks which are caused by the difference of heat expansion coefficients between the supporting plates 13 and the supporting rods 19 or at the time of sealing them into the enclosure can be prevented.

Since the length of the supporting rods 19 at both side parts of the supporting plate 13 is selected to be larger than that at the center part of the supporting plate 13, only the supporting rods 19 at both side parts touch the fluorescent layer 2 when the supporting plate 13 and the supporting rod 19 and so on are inserted into the enclosure. Therefore, during the insertion, the main part of the fluorescent layer 2 is not damaged even when the supporting rod 19 moves a little. Then, when the inside space of the enclosure is evacuated, the supporting rods 19 at the center of the supporting plate 13 uniformly touch the fluorescent layer 2 due to the atmospheric pressure and do not move thereafter. Therefore, the supporting rod 19 can be assembled without any damaging of the fluorescent layer part of the picture area.

Since the electrodes 16 are formed on both surfaces of the supporting plate 13 by the adhesive 18 with the spacers 17 the supporting plate 13 can hardly warp. For example, in comparison with a conventional example, wherein the supporting plate 13 is made of glass of 300 mm length and had 80–100 μm warps, the warp in the apparatus of the present invention of the same size has warps of only 10–30 μm. In the above embodiment, since the electrodes 16 serve also as means for removing the warp of the supporting plate 13, another special member for removing the warp is not necessary, thereby avoiding superflous cost.

Figure 8:
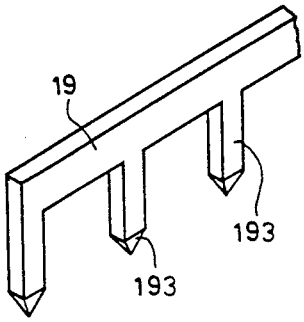
FIG. 8 is a perspective view showing supporting means of the present invention.
Figure 9:
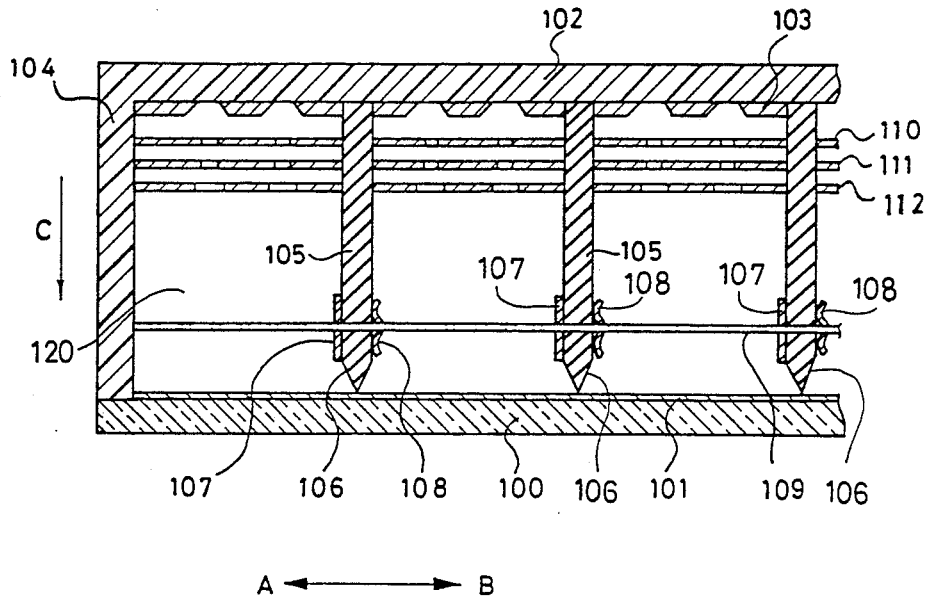
FIG. 9 (Prior Art)
FIG. 9 is the cross-sectional view showing the conventional display apparatus.

Further, the supporting rod 18 may be a thin strip which has plural protrusions 193 of a predetermined length as shown in FIG. 8. The protrusions 193 are formed on the strip at intervals of a predetermined distance.

According to the configuration of the present invention, the method for detecting the scanning position and timing can be satisfactorily applied to the embodiment of the present invention since the supporting rods are not of the plate type but are of the tapered protrusion type, wherein the electron beams can be over-scanned by crossing the supporting rods to some extent, thereby assuring effective distortion adjustment. Further, since a supporting rod is not a plate, a warp or bend of the supporting rod hardly occurs. Therefore, the shadow causing image noise is substantially eliminated.

Although the invention has been described in its preferred form with a certain degree of particularity, it is understood that the present disclosure of the preferred form may be changed in the details of construction and the combination and arrangement of parts may be resorted to without departing from the spirit and the scope of the invention as hereinafter claimed.

What is claimed is:

1. A display apparatus comprising:

a face plate having a phosphor screen on an inner surface thereof, a rear plate provided apart from said face plate in parallel, side plates for forming a vacuum cavity by connecting said face plate and said rear plate with a given space therebetween, electron beam emitting means within said cavity for emitting electron beams, and plural rectangular supporting plates disposed in parallel to each other between said face plate and said rear plate, and substantially perpendicular to said face plate, wherein each respective supporting plate is supported by a plurality of column-shaped supporting rods, one end of each of said supporting rods being bonded by adhesive on an end of each respective supporting plate facing said face plate, said supporting rods being bonded at intervals of a certain distance in a lengthwise direction of each respective supporting plate, the other end of each of said supporting rods being tapered and touching said face plate at predetermined points.

2. A display apparatus in accordance with claim 1, wherein said supporting rods are made of metal.

3. A display apparatus comprising:

a face plate having a phosphor screen on an inner surface thereof, a rear plate provided apart from said face plate in parallel, side plates for forming a vacuum cavity by connecting said face plate and said rear plate with a given space therebetween, electron beam emitting means within said cavity for emitting electron beams, plural rectangular supporting plates disposed in parallel to each other between said face plate and said rear plate, and substantially perpendicular to said face plate, wherein each respective supporting plate is supported by a plurality of column-shaped supporting rods, one end of each of said supporting rods being bonded by adhesive on an end of each respective supporting plate facing said face plate, said supporting rods being bonded at intervals of a certain distance in a lengthwise direction of each respective supporting plate, the other end of each of said supporting rods being tapered and touching said face plate at predetermined points, and guide means respectively disposed on both sides of said supporting plates for guiding said supporting rods and covering said adhesive.

4. A display apparatus comprising:

a face plate having a phosphor screen on an inner surface thereof, a rear plate provided apart from said face plate in parallel, side plates for forming a vacuum cavity by connecting said face plate and said rear plate with a given space therebetween, electron beam emitting means within said cavity for emitting electron beams, plural supporting means disposed in parallel to each other between said face plate and said rear plate, and substantially perpendicular to said face plate, for supporting said face plate against atmospheric pressure outside said vacuum cavity, and respective electrode means including one electrode provided apart from respective surfaces of each of said supporting means by a space by using spacer means and adhesive along the paths of each of said electron beams.

5. A display apparatus in accordance with claim 4, wherein each said electrode means includes a pair of other electrodes, hung over said space between said supporting means and said electrode means, formed on respective surfaces of said supporting means.

6. A display apparatus comprising:

a face plate having a phosphor screen on an inner surface thereof, a rear plate provided apart from said face plate in parallel, side plates for forming a vacuum cavity by connecting said face plate and said rear plate with a given space therebetween, electron beam emitting means within said cavity for emitting electron beams, plural supporting means disposed in parallel to each other between said face plate and said rear plate, and substantially perpendicular to said face plate, for supporting said face plate against atmospheric pressure outside said vacuum cavity, and each supporting means including a plurality of beam deflection electrodes, each beam deflection electrode having almost the same length as each other beam deflection electrode along the paths of each of said electron beams and also having almost the same length as each supporting means in a lengthwise direction thereof, each beam deflection electrode being disposed on a respective surface of each of said supporting means, and one of more than one of said beam deflection electrodes disposed on the same surface of one of said supporting means being bonded to a spacer member which is also bonded to said surface of said one supporting means by adhesive.

7. A display apparatus in accordance with claim 6, wherein said one beam deflection electrode bonded to said spacer member spatially overlaps other beam deflection electrodes on the same surface of said one supporting means.

8. A display apparatus in accordance with claim 6, wherein said one beam deflection electrode bonded to said spacer member functions as warp removing means for removing a warp of said one supporting means.

9. A display apparatus in accordance with claim 6, wherein said spacer member contacts an insulative part of said one beam deflection electrode bonded to said spacer member and an insulative part of said one supporting means.

10. A display apparatus comprising:

a face plate having a phosphor screen on an inner surface thereof, a rear plate provided apart from said face plate in parallel, side plates for forming a vacuum cavity by connecting said face plate and said rear plate with a given space therebetween, electron beam emitting means within said cavity for emitting electron beams, plural rectangular supporting plates disposed in parallel to each other between said face plate and said rear plate, and substantially perpendicular to said face plate, wherein each respective supporting plate is supported by a plurality of column-shaped supporting rods, one end of each of said supporting rods being bonded by adhesive on an end of each respective supporting plate facing said face plate, said supporting rods being bonded at intervals of a certain distance in a lengthwise direction of each respective supporting plate, the other end of each of said supporting rods being tapered and touching said face plate at predetermined points, and each supporting plate including a plurality of beam deflection electrodes, each beam deflection electrode having almost the same length as each other beam deflection electrode along the paths of each of said electron beams and also having almost the same length as each supporting plate in a lengthwise direction thereof, each beam deflection electrode being disposed on a respective surface of each of said supporting plates.

11. A display apparatus comprising:

a face plate having a phosphor screen on an inner surface thereof, a rear plate provided apart from said face plate in parallel, side plates for forming a vacuum cavity by connecting said face plate and said rear plate with a given space therebetween, electron beam emitting means within said cavity for emitting electron beams, plural rectangular supporting plates disposed in parallel to each other between said face plate and said rear plate, and substantially perpendicular to said face plate, wherein each respective supporting plate is supported by a plurality of column-shaped supporting rods, one end of each of said supporting rods being bonded by adhesive on an end of each respective supporting plate facing said face plate, said supporting rods being bonded at intervals of a certain distance in a lengthwise direction of each respective supporting plate, the other end of each of said supporting rods being tapered and touching said face plate at predetermined points, and each supporting plate including a plurality of beam deflection electrodes, each beam deflection electrode having almost the same length as each other beam deflection electrode along the paths of each of said electron beams and also having almost the same length as each supporting plate in a lengthwise direction thereof, each beam deflection electrode being disposed on a respective surface of each of said supporting plates, and one of more than one of said beam deflection electrodes disposed on the same surface of one of said supporting plates being bonded to a spacer member which is also bonded to said surface of said one supporting plate by adhesive.

12. A display apparatus in accordance with claim 11, wherein said one beam deflection electrode bonded to said spacer member spatially overlaps other beam deflection electrodes on the same surface of said one supporting plate.

13. A display apparatus in accordance with claim 11, wherein said one beam deflection electrode bonded to said spacer member functions as warp removing means for removing a warp of said one supporting plate.

14. A display apparatus in accordance with claim 11, wherein said spacer member contacts an insulative part of said one beam deflection electrode bonded to said spacer member and an insulative part of said one supporting plate.

* * * * *